US005102704A

United States Patent [19]

Misawa et al.

[11] Patent Number: 5,102,704

[45] Date of Patent: Apr. 7, 1992

[54] TUBULAR FELT FOR GRINDING USE

[75] Inventors: Shousuke Misawa, Tokyo; Tetsuo Takeuchi; Takeshi Ogiwara, both of Ichikawa, all of Japan

[73] Assignee: Ichikawa Woolen Textile Co., Ltd., Tokyo, Japan

[21] Appl. No.: 558,817

[22] Filed: Jul. 27, 1990

[30] Foreign Application Priority Data

Aug. 15, 1989 [JP] Japan ..... 1-210259

[51] Int. Cl.[5] ..... B32B 5/06; B32B 5/26; B32B 31/26; B24D 11/02

[52] U.S. Cl. ..... 428/34.7; 51/400; 51/404; 428/34.9; 428/36.1; 428/234; 428/259

[58] Field of Search ..... 428/34.7, 34.9, 36.1; 51/400, 404

[56] References Cited

U.S. PATENT DOCUMENTS

| | | | |
|---|---|---|---|
| 2,347,244 | 4/1944 | Colt et al. | 51/404 |
| 3,324,609 | 6/1967 | Stein et al. | 51/400 |
| 4,325,998 | 4/1982 | Chapman | 428/34.9 |
| 4,400,418 | 8/1983 | Takeda et al. | 428/36.1 |
| 4,631,098 | 12/1986 | Pithouse et al. | 428/34.9 |
| 4,816,309 | 3/1989 | Hutt et al. | 428/34.9 |
| 4,841,684 | 6/1989 | Hall | 51/400 |

FOREIGN PATENT DOCUMENTS

| | | | |
|---|---|---|---|
| 3431600 | 3/1986 | France | 428/34.9 |
| 48109 | 9/1981 | Japan | 51/400 |

*Primary Examiner*—James C. Cannon
*Attorney, Agent, or Firm*—Flynn, Thiel, Boutell & Tanis

[57] ABSTRACT

A tubular felt useful in the grinding of the panel face of a cathode ray tube is made up of a fabric woven with a non heat-shrinkable warp and a heat-shrinkable weft; a heat-shrinkable batt bonded to the surface of said fabric by needling; and a non heat-meltable, hygroscopic fiber mixed with at least one of the heat-shrinkable weft and heat-shrinkable batt.

2 Claims, 1 Drawing Sheet

TUBULAR FELT FOR GRINDING USE

FIELD OF THE INVENTION

The present invention relates to a tubular felt used in grinding and, in particular, a tubular felt especially suited for grinding a panel face of a cathode ray tube.

BACKGROUND OF THE INVENTION

Conventionally, in grinding a panel face of a cathode ray tube, a tubular, woven felt which is attached to a rubber drum mounted on a pressurized air grinding machine is used. Such a woven felt conventionally comprises a fabric woven from a yarn made by mix spinning wool and nylon and subsequent milling of the yarn in an acidic or alkali solution.

In using the above-mentioned conventional tubular felt for grinding, the quality of the obtained ground panel face is fairly good. However, since its glass grinding capability is somewhat inferior, the time required for the grinding operation is prolonged and since its anti-wear property is also insufficient, its useful life is rather limited.

On the other hand, when using a tubular felt made of synthetic fibers, since its porosity is relatively small, water may not be retained in the felt. Moreover, the hygroscopic property of the fiber itself is inferior and heat generated during the grinding operation may not be readily radiated. Thus, due to the heat generated during the grinding operation, the fibers tend to melt and form a membrane. When this phenomenon takes place, the ground particles tend to accumulate on the surface of the membrane, which in turn causes damage to the ground surface. Furthermore, although the synthetic fiber tubular felt is superior to the woven felt in terms of the grinding speed and durability, the quality of the finished surface is inferior with possible damage to the ground surface as mentioned above.

OBJECT OF THE INVENTION

The object of the present invention is to provide a tubular felt for grinding use which has superior durability and a high water retention capability with no likelihood of melting and membrane forming.

SUMMARY OF THE INVENTION

To achieve the above-mentioned object, there is provided a tubular felt for grinding use comprising:

- a fabric woven with a non heat-shrinkable warp and a heat-shrinkable weft;
- a heat-shrinkable butt bonded to the surface of said fabric by needling; and
- a non heat-meltable, hygroscopic fiber mixed with at least one of said heat-shrinkable weft and heat-shrinkable butt.

Furthermore, when the above-mentioned hygroscopic fiber is wool, the tubular felt is superior in terms of hygroscopic properties and possesses a high degree of resiliency.

BRIEF DESCRIPTION OF THE DRAWINGS

FIG. 2(*b*) is a section of a conventional tubular felt showing the texture thereof.

DETAILED DESCRIPTION OF THE INVENTION

Figure 1:
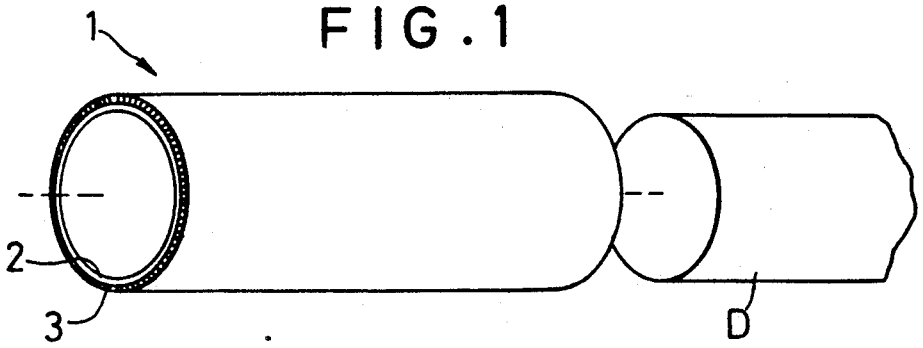
FIG. 1 is a schematic representation of a tubular felt according to the present invention.

Hereinafter, one embodiment of the present invention will be described with reference to the attached drawings.

In the drawings, reference numeral 1 denotes a main body of the tubular felt, which is made in a tubular shape so that it may be mounted on a drum D of a pressurized air drum type grinding machine. The main body 1 comprises a tubular fabric 2 and a butt 3. Said fabric 2 comprises a non heat-shrinkable warp 4 (axial direction) and a heat-shrinkable weft 5 (circumferential direction) woven in the form of a tube.

Batt 3 comprises a short fiber layer made by the mixed spinning of a primary component of a heatshrinkable polyester type synthetic fiber with a non heat-meltable, hygroscopic fiber which is 30% or less by weight of the short fiber layer so as to have a high heat shrinkage in the temperature range of from 70° to 80° C. Here, "non heat-meltable" property refers to the lack of the likelihood of the fibers melting and changing to a membrane because of the friction heat. By way of examples of fibers having the required hygroscopic properties, they may be either wool, rayon or cotton, or mixtures thereof at an appropriate proportion. In the described embodiment, wool is utilized because wool is excellent in terms of resiliency and affinity with the ground surface. Said batt 3 is bonded to the surface of the fabric 2 by means of needling such that displacement will not occur even if a large frictional force is applied during the grinding operation.

Figure 2:
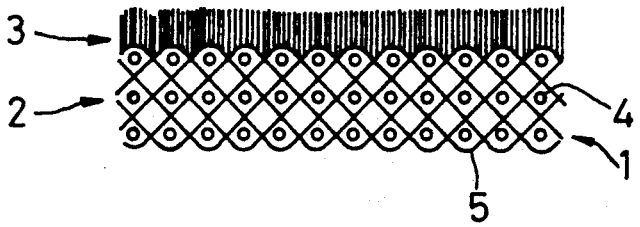
FIG. 2(*a*) is a section of the tubular felt according to the present invention showing the texture thereof.
Figure 2:
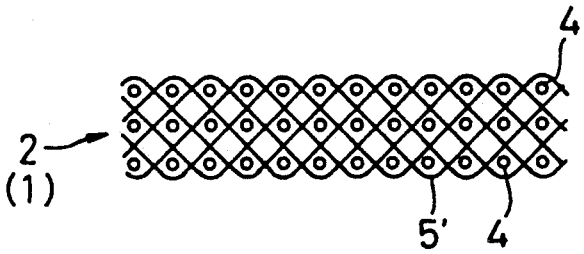

The warp 4 comprises a non heat-shrinkable fiber, such as, a nylon type, synthetic fiber. On the other hand, the weft 5, like the above-mentioned batt 3, comprises a fiber having a high heat shrinkage in the temperature range of from 70° to 80° C., such as a polyester type fiber, and a non heat-meltable, hygroscopic fiber, said fibers being prepared by mixed spinning (FIG. 2(*a*)). The weft 5 in the described embodiment, like the batt 3, is prepared by the mixed spinning of a primary component of polyester type synthetic fiber with wool, which is present at 30% or less by weight. It is also to be noted that in the product tubular felt, the yarn in the circumferential direction may sometimes be called "warp'; and the yarn in the axial direction may be called "weft", respectively. However, in this specification, the designation is based at the time when the tubular felt is woven; and thus, the yarn in the direction of the generatrix is designated "warp"; and the yarn in the circumferential direction is designated "weft".

The fabric 2 is first mounted on the drum D; and then, hot water at a temperature of from 70° to 80° C. is poured onto the butt 3. Then, a rapid heat shrinkage takes place in the butt 3 as well as in the weft 5 in the fabric 2 and the fabric 2 is strongly secured to the surface of the drum D. At the same time, the batt 3 may be turned into a highly anti-wear felt suited for grinding having an appropriate resiliency and hardness. Furthermore, weft 5 and batt 3 are capable of retaining water during the grinding operation so as to radiate heat effectively while exhibiting a good affinity of wool with the ground surface.

Figure 3:
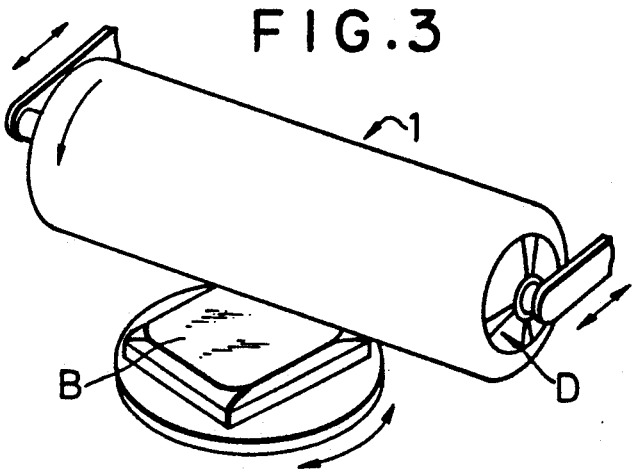
FIG. 3 is a perspective view illustrating how a panel face of a cathode ray tube is ground utilizing a tubular felt.

As shown in FIG. 3, the tubular felt according to the present invention was used to grind a panel face of a cathode ray tube so as to compare the performance thereof with that of a conventional woven felt made by the mixed spinning of wool and nylon. The tubular felt according to the present invention exhibited excellent anti-wear property and its useful life was substantially improved. Moreover, since its glass grinding capability had been substantially improved, the time required to finish the grinding of one panel face was reduced.

That is, the test results shown in Table 1 was obtained with the following conditions:

Drum RPM: 580 rpm
Pressure: 0.8 kg/cmz
Concentration of grinding fluid: 1.2%
Grinding Time: 50 hours

TABLE 1

| | Conventional tubular felt | Present invention |
|---|---|---|
| Amount of ground glass | 97 grams | 308 grams |
| Useful life | 92 hours | 120 hours |

It will be observed from Table 1 that the tubular felt according to the present invention is superior to the conventional tubular felt in terms of grinding capability and useful life and it may be presumed that the quality of the ground surface will be better since there is no likelihood of biting particles which may arise if the fibers melt and change to a membrane as mentioned before.

Since the present invention provides a tubular felt for grinding use comprising a fabric woven with a non heat-shrinkable warp and a heat-shrinkable weft and a heat-shrinkable batt bonded to the surface of said fabric by needling and a non heat-meltable, hygroscopic fiber being mixed with at least one of said heatshrinkable weft and heat-shrinkable batt, the fabric may be strongly secured to the drum of a grinding machine by simply pouring hot water thereon which simultaneously makes the felt solid and dense with a superior grinding capability. In addition, owing to the blending of the heat-shrinkable synthetic fiber and non heat-meltable, hygroscopic fiber, the good heat radiation properties of the hygroscopic fiber may be added to the good grinding capability and anti-wear properties of the synthetic fiber. Particularly, because of the blending of the heat-shrinkable synthetic fiber with wool, the excellent hygroscopic properties and the affinity with the ground surface of wool may be made fully available.

Consequently, the mounting of the tubular felt will not only be facilitated, but the strength as well as the anti-wear property of the grinding surface will also be substantially improved. Also, the useful life of the tubular felt will be increased and the efficiency of the grinding work will be substantially improved. Furthermore, since the melting and changing to a membrane of the grinding surface will be prevented because of the hygroscopic properties and the non heatmeltability properties of the fibers constituting the felt, the likelihood of damage to the ground surface will be eliminated which results in the ground surface being of high quality. Moreover, since the tubular felt according to the present invention may be mounted to cylindrical bodies other than the grinding drum, it may be also used as shock absorbing materials in conveyor drums or conveyor rolls, noise absorbing materials, or surface protection materials, etc.

What is claimed is:

1. A tubular felt used in grinding comprising:
   a fabric woven with a non heat-shrinkable warp and a heat-shrinkable weft;
   a heat-shrinkable batt bonded to the surface of said fabric by needling; and
   a non heat-meltable, hygroscopic fiber mixed with at least one of said heat-shrinkable weft and heat-shrinkable batt.

2. The tubular felt according to claim 1 wherein said hygroscopic fiber is wool.

* * * * *